US007373748B2

(12) United States Patent
Pitcher et al.

(10) Patent No.: US 7,373,748 B2
(45) Date of Patent: May 20, 2008

(54) ELONGATED POSTER SUPPORT ARRANGEMENT

(75) Inventors: David E. Pitcher, Cambridge, MA (US); Thomas D. Borroos, Andover, MA (US)

(73) Assignee: Rose Displays Ltd., Salem, MA (US)

( * ) Notice: Subject to any disclaimer, the term of this patent is extended or adjusted under 35 U.S.C. 154(b) by 370 days.

(21) Appl. No.: 11/018,345

(22) Filed: Dec. 21, 2004

(65) Prior Publication Data

US 2005/0097800 A1 May 12, 2005

Related U.S. Application Data

(63) Continuation-in-part of application No. 10/616,433, filed on Jul. 9, 2003, now abandoned.

(51) Int. Cl.
*G09F 3/20* (2006.01)

(52) U.S. Cl. ..... 40/658; 40/661.01; 40/617; 248/316.3; 281/45; 24/462

(58) Field of Classification Search ..... 40/658, 40/661.01, 666, 617; 211/89.01; 24/67 R, 24/460, 462; 248/316.3; 281/45
See application file for complete search history.

(56) References Cited

U.S. PATENT DOCUMENTS

| | | | | |
|---|---|---|---|---|
| 1,417,009 | A * | 5/1922 | Woodward | 223/91 |
| 2,377,488 | A * | 6/1945 | Fugazzi | 248/316.3 |
| 2,755,585 | A * | 7/1956 | Lubow | 40/367 |
| 3,168,954 | A * | 2/1965 | Von Herrmann | 211/50 |
| 3,298,647 | A * | 1/1967 | Shepard | 248/101 |
| 3,399,429 | A * | 9/1968 | Goodman | 24/67 R |
| 3,591,013 | A * | 7/1971 | Von Herrmann | 211/50 |
| 3,675,782 | A * | 7/1972 | Dudley | 211/50 |
| 3,754,663 | A * | 8/1973 | Bittner | 211/89.01 |
| 3,814,368 | A * | 6/1974 | Freed | 248/316.3 |
| 4,039,134 | A * | 8/1977 | Redmer | 248/205.3 |
| 4,507,830 | A * | 4/1985 | Dahan | 24/527 |
| 4,693,443 | A * | 9/1987 | Drain | 248/447.1 |
| 5,048,698 | A | 9/1991 | Konrad | 211/45 |
| 5,078,358 | A | 1/1992 | Egly et al. | 248/447.1 |
| 5,152,490 | A | 10/1992 | Deutsch | 248/452 |
| 5,170,982 | A | 12/1992 | Schultheis et al. | 248/316.3 |
| 5,188,332 | A | 2/1993 | Callas | 248/544 |
| 5,592,721 | A | 1/1997 | Zeller | 24/460 |
| 5,711,430 | A | 1/1998 | Andersen et al. | 211/45 |
| 6,003,259 | A | 12/1999 | Krapf et al. | 40/658 |
| 6,182,936 | B1 | 2/2001 | Yang | 248/442.2 |
| 6,302,362 | B1 | 10/2001 | Moore | 348/73 |
| D520,862 | S | 5/2006 | Munson et al. | D8/354 |

* cited by examiner

*Primary Examiner*—Gary C. Hoge
(74) *Attorney, Agent, or Firm*—Don Halgren

(57) ABSTRACT

An elongated poster support arrangement comprising an elongated extrusion having an uppermost wall, a first tapered sidewall and a second tapered sidewall. The first and second sidewalls angularly extend from the uppermost wall. A central support wall is arranged between the first and the second tapered sidewalls to define a first longitudinal chamber between the first tapered sidewall and the central support wall and also to define a second longitudinal chamber between the second tapered sidewall and the central support wall. An arrangement of gripping members is loosely disposed within the second longitudinal chamber. The second chamber is arranged to receive a poster therein for pinched securement between the gripping members and the central support wall.

6 Claims, 6 Drawing Sheets

ELONGATED POSTER SUPPORT ARRANGEMENT

BACKGROUND OF THE INVENTION

1. Field of the Invention

The present invention relates to devices for supporting posters from an overhead surface, and more in particularly to an extrusion which readily receives posters, and which extrusion may be readily attached to a ceiling rail or dis-attached from that ceiling rail in a simple manner. This application incorporates by reference co-pending application Ser. No. 10/616,419 filed Jul. 9, 2003, and Ser. No. 10/660,909 filed Jun. 4, 2004 and Ser. No. 10/616,439 filed Jul. 9, 2003, and also is a continuation-in-part application of application Ser. No. 10/616,433 filed Jul. 9, 2003 now abandoned.

2. Prior Art

In the merchandising field particularly as it relates to customers in department stores and shopping malls and the like, poster advertisements are critical. They are changed frequently and often moved around in order to advertise goods and to catch the customer's attention. Setup and the support assembly of these posters has to be very simple to permit the attachment and removal of posters and advertisements from a ceiling rail by relatively low paid employees of that merchandiser or store. stepladder or careful, difficult alignment and manipulation of a tool by which the poster is attached to a ceiling rail or removed from a ceiling rail.

It is an object of the present invention to overcome the disadvantages of the prior art.

It is yet a further object of the present invention to provide a poster support arrangement which will safely grasp and hold a poster inserted therein in a safe and efficient manner.

It is still yet a further object of the present invention to provide a poster support arrangement which will permit the simple removal of the poster support arrangement from an overhead ceiling rail.

It is still yet another object of the present invention to provide a poster support arrangement which will permit the poster to be removed therefrom and a new poster inserted without damaging the poster or the support arrangement in a manner not shown or suggested by the prior art.

BRIEF SUMMARY OF THE INVENTION

The present invention comprises a poster support arrangement for the receipt of a flat poster therewithin and for the facile attachment of that elongated poster support arrangement to a ceiling rail overhead. A ceiling rail is typically an inverted, steel "T" shaped member which normally supports the ceiling tiles in a commercial merchandising establishment. The poster support arrangement of the present invention does comprise an elongated extrusion having a first end and a second end. Each end, that is, the first end and the second end may have an end cap thereon. The elongated extrusion comprising the poster support arrangement has a generally elongated, flat, uppermost side. The elongated poster support extrusion has a first tapered sidewall extending from one edge of the uppermost side at an angle of about 75 degrees. The first tapered sidewall has a lowermost or distal edge extending inwardly thereon. The elongated uppermost side has a second tapered sidewall extending downwardly therefrom in a manner generally similar to the first tapered sidewall. The second tapered sidewall has a lower or distalmost edge which extends beyond the distalmost edge of the first tapered sidewall. The distalmost edge of the second tapered sidewall has an inwardly projecting flange portion arranged therealong.

An elongated central support wall is disposed between the first tapered sidewall and the second tapered sidewall in a manner generally perpendicular to the uppermost side. The central support wall has a first or uppermost edge with a connecting web unitary with the first tapered sidewall and a second connecting web unitary with the second tapered sidewall. The first and second connecting webs hold the central support wall in generally rigid alignment with the first and second tapered sidewalls and the upper most side.

The central support wall has a distal or lowermost edge which extends beyond the distalmost edge of the second tapered sidewall and the distalmost edge of the first tapered sidewall. A narrow longitudinally extending gap is disposed between the distalmost edge of the second tapered sidewall and the respective side of the central support wall. A second relatively narrow gap or open band is longitudinally disposed between the central support wall and the distalmost edge or flange of the first tapered sidewall. The volume between the central support wall and the second tapered sidewall defines a "gripping means" enclosure chamber.

The gripping means enclosure chamber is elongated and is arranged to receive a gripping means disposed longitudinally therewithin. The volume between the central support wall and the first tapered sidewall and connecting web defines an elongated "lift-tool" receiving chamber. The elongated lift-tool receiving chamber is arranged to receive a poster support arrangement lift tool to permit the raising and lowering of the poster and the poster support arrangement relative to an elevated ceiling rail in a store.

The gripping means in a first preferred embodiment thereof comprises a plurality of soft resilient "sausage-like" links of resilient material connected therethrough by a central flexible connector line. Each of the links may be defined as roller links made of plastic or rubber or the like which are independently movable with respect to its adjacent link in either a twisting or rotation about the common flexible connector line extending therethrough. The roller link arrangement may be formed in a series of link molds having the elongated connector line centrally disposed therethrough in the mold apparatus, so that the connector line is physically secured to the respective individual roller link members within that mold.

The assembly of the poster support arrangement comprises the insertion of a plurality of longitudinally connected resilient roller links arranged within the gripping means enclosure chamber and loosely disposed therewithin. The end caps may be put on each end of the longitudinal extrusion to prevent the roller link members from falling out during lifting of the poster support arrangement onto a ceiling rail. The end caps may have a slot extending from a vertex thereof toward the upper side of the extrusion, to permit a plurality of poster support arrangements to hold a poster which is longer than any individual single poster support arrangement. The slots also permit easy removal of a poster from the support arrangement by allowing the poster to be slid sideways relative to the gripping rollers.

A poster may be inserted within the gripping means enclosure chamber parallel to and along side the central support wall. Insertion of a flexible poster is accommodated by the roller links neatly rotating about their flexible connector line and permitting the insertion of the poster thereadjacent. Gravity pulls the individual roller links towards the lowermost vertex of the poster support arrangement extrusion and sufficiently secures it in a pinching manner to prevent the poster from falling out when it is in its overhead location on a ceiling rail.

A poster support arrangement lift tool may be utilized to lift the poster support arrangement onto the ceiling rail and secured thereto by a magnetic means therebetween or the like. The poster support arrangement lift tool comprises a blade-like apparatus arranged on the distalmost end of an elongated pole. The pole may be telescopable or long enough to reach a ceiling rail. The planar blade is fixedly arranged on the distal end of the pole. The blade may have a linear or straight edge having a scive thereon. It is intended that the blade have a width of about 2-3 inches. The planar blade is inserted into the gap between the central support wall and the first tapered wall in the elongated tool receiving chamber therebetween.

A tapered lock member may be arranged as a wedge on a first side of the blade of the tool, so as to provide a slight press-fit or interference securement means between the blade and the poster support arrangement. The tapered lock member mates within the flange at the lowermost side of the first tapered sidewall. A simple tilting of the blade with respect to the poster support arrangement will permit the separation of blade of the tool from the elongated tool receiving chamber.

Thus what has been shown is a unique arrangement for supporting a poster on a ceiling rail in a most simple and easily usable manner.

The invention thus comprises an elongated poster support arrangement comprising an elongated extrusion having an uppermost wall, a first tapered sidewall and a second tapered sidewall, said first and second sidewalls angularly extending from said uppermost wall; a central support wall arranged between the first and the second tapered sidewalls to define a first longitudinal chamber between the first tapered sidewall and the central support wall and also to define a second longitudinal chamber between the second tapered sidewall and the central support wall; and an arrangement of gripping members loosely disposed within the second longitudinal chamber, the second chamber arranged to receive a poster therein for pinched securement between the gripping members and the central support wall.

The first longitudinal chamber may have a slot which is arranged to receive a lift tool to permit the poster support to be lifted to a ceiling rail. The first tapered wall has a distalmost edge, and the second tapered wall has a distalmost edge, and wherein the distalmost edge of the central support wall extends beyond the distalmost edges of the first and the second tapered walls. The central support wall has a proximal edge which may be attached to the tapered side walls by a pair of connecting webs. The first tapered side wall has a flange on its distalmost edge, to facilitate engagement of the lift tool therewith. The gripping members comprise a plurality of generally cylindrically shaped links connected longitudinally together by a flexible connecting line. The lift tool has a planar blade arranged to fit into the first chamber. The planar blade may have a locking member thereon to engage the flange on the first tapered side wall of the elongated extrusion. The uppermost wall may have a magnet member thereon to facilitate attachment of the extrusion to an overhead ceiling rail. The gripping members are preferably formed from a resilient material to enhance their gripping and pinching capabilities.

The invention thus also comprises a method of hanging a poster from a ceiling support comprising the steps of: arranging an elongated extrusion so as to retentatively receive a planar poster in a first slot therein, the extrusion having a second slot for receipt of a blade of a lifting tool; inserting a poster in the first slot in the extrusion; inserting a blade in the second slot; and raising the extrusion with the poster therein onto a ceiling rail for securement thereto.

The method may also include the steps of: mounting a magnetic strip onto an upper side of the extrusion to permit the extrusion to be secured to the ceiling rail; inserting an arrangement of links in a chamber in the elongated extrusion to permit the poster inserted therein to be retained therein; placing a locking member on a side of the blade to permit the blade to be secured to the first slot in said extrusion during the raising of the extrusion to the ceiling rail; placing a sloped surface on at least one side of the locking member to permit the lifting tool to be leveraged from the extrusion by the locking member, for removal of the extrusion therefrom; placing a sloped surface on a front face of the locking member to permit said lifting tool to leverage said extrusion from magnetic attachment to said rail; pivoting the lifting tool to one side to liberate the lifting tool from engagement in the second slot; pivoting the lifting tool in a direction perpendicular to the planar blade to move and unsecure the extrusion from the ceiling rail.

BRIEF DESCRIPTION OF THE DRAWINGS

The objects and advantages of the present invention will become more apparent when viewed in conjunction with the following drawings in which.

DETAILED DESCRIPTION OF THE PREFERRED EMBODIMENTS

Figure 1A:
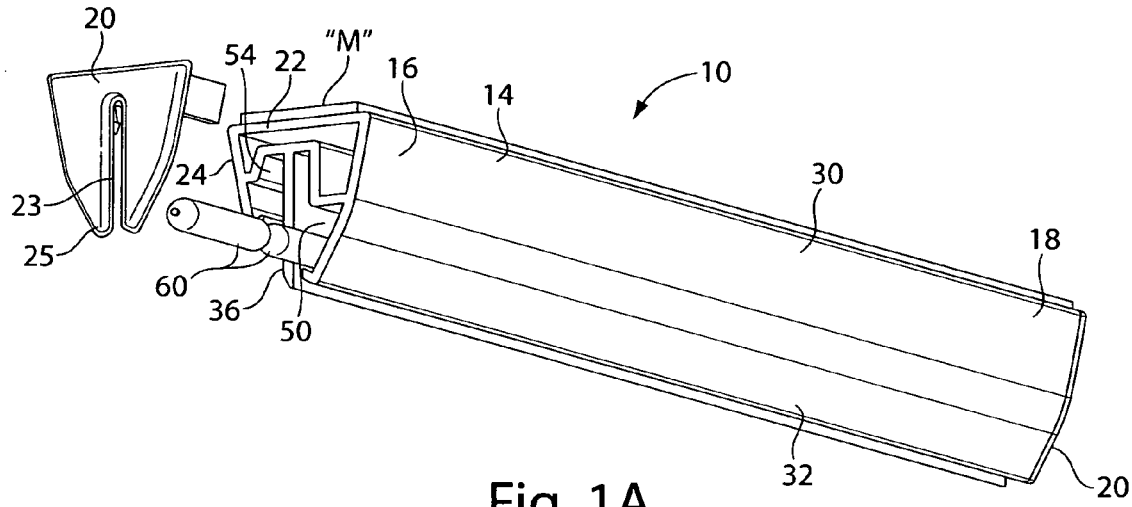
FIG. 1A is an exploded perspective view of the poster support arrangement shown in FIG. 1.
Figure 1B:
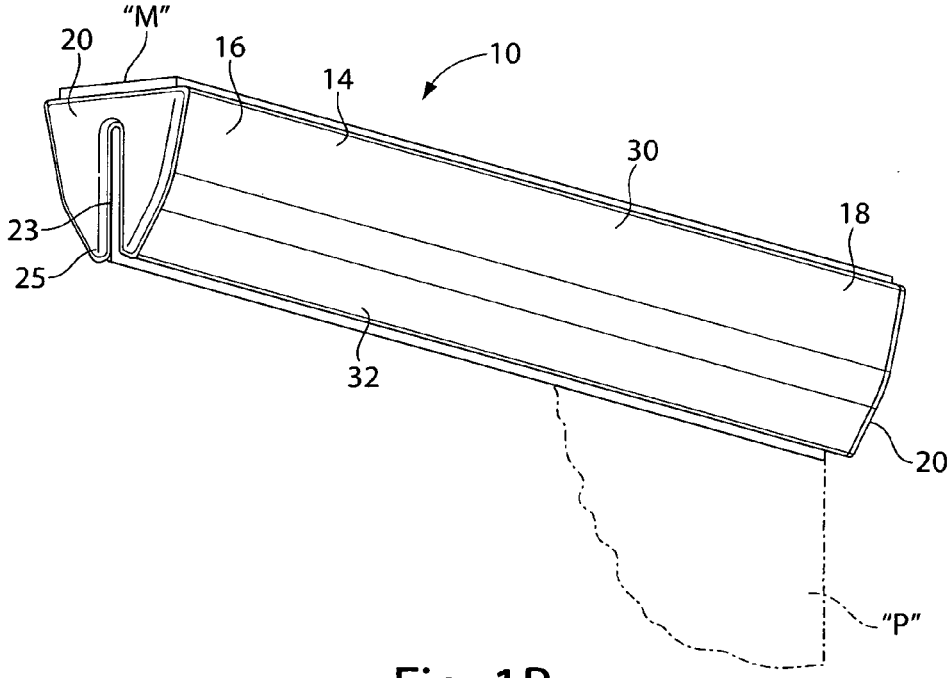
FIG. 1 is a perspective view of a poster support arrangement constructed according to the principles of the present invention.

Referring now to the drawings in detail, and particularly to FIG. 1, there is shown the present invention which comprises a poster support arrangement 10 for the receipt of a flat flexible poster "P" therewithin and for the facile attachment of that elongated poster support arrangement 10 to a ceiling rail "R" overhead, as represented in FIGS. 3, 6, 7 and 8. A ceiling rail "R" is typically an inverted "T" shaped member which normally supports the ceiling tiles 12 in a commercial merchandising establishment.

The poster support arrangement 10 of the present invention does comprise an elongated extrusion 14 having a first end 16 and a second end 18, as shown in FIGS. 1 and 1A. Each end, that is, the first end 16 and the second end 18 may have an end cap 20 thereon. The end cap 20 is shown in FIG. 1A in an exploded manner, displaying a series of fiber connected links 60 arranged therewithin, which links 60 will be described in greater detail hereinbelow. The elongated extrusion 14 comprising the poster support arrangement 10 has a generally elongated, flat, uppermost side 22. The elongated poster support extrusion 14 has a first tapered sidewall 24 extending from one edge of the uppermost side 22 at an angle of about 75 degrees, as may be seen best in FIGS. 2 and 3. The first tapered sidewall 24 has a lowermost or distal edge 26 with a lip or flange 28 extending inwardly thereon. The elongated uppermost side 22 has a second tapered sidewall 30 extending downwardly therefrom in an angled manner of about 75 degrees with respect to the uppermost side 22, generally similar to the first tapered sidewall 24, as may be seen in FIG. 1A. The second tapered sidewall 30 has a lower or distalmost edge 32 which extends beyond the distalmost edge 26 of the first tapered sidewall 24. The distalmost edge 32 of the second tapered sidewall 30 has an inwardly projecting flange 34 arranged therealong, as best shown in FIGS. 2 and 3.

Figure 2:
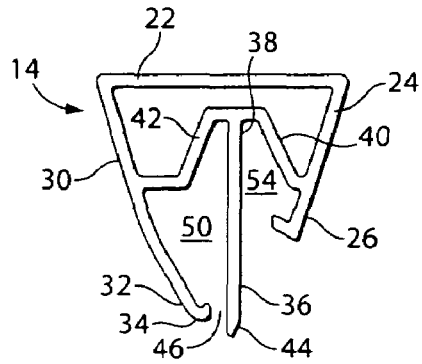
FIG. 2 is an end view of the elongated extrusion of the present invention.
Figure 3:
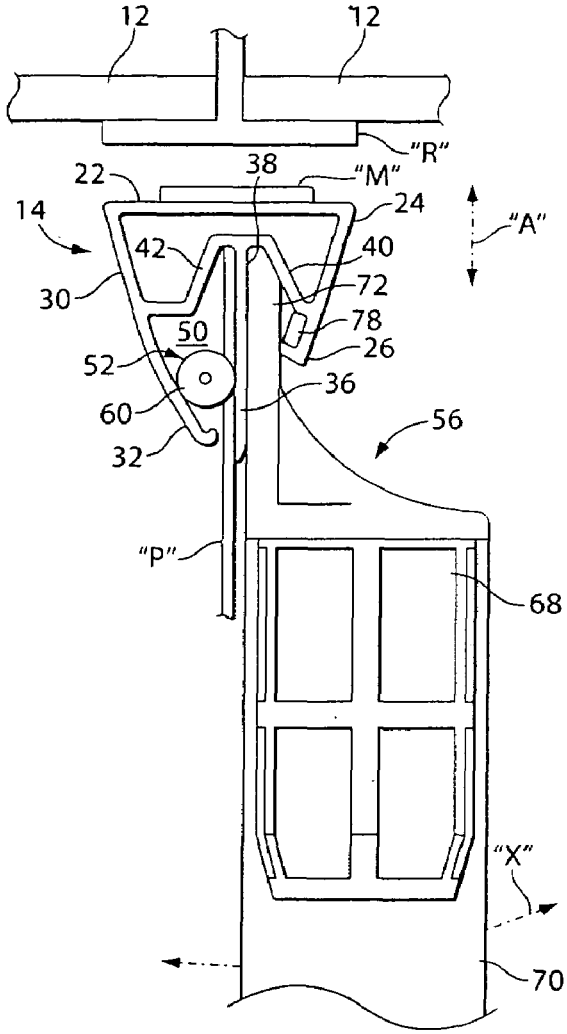
FIG. 3 is an end view of the extrusion of the present invention with the gripping means, a poster and the poster support arrangement lift tool therewith shown approaching a ceiling rail.
Figure 4:
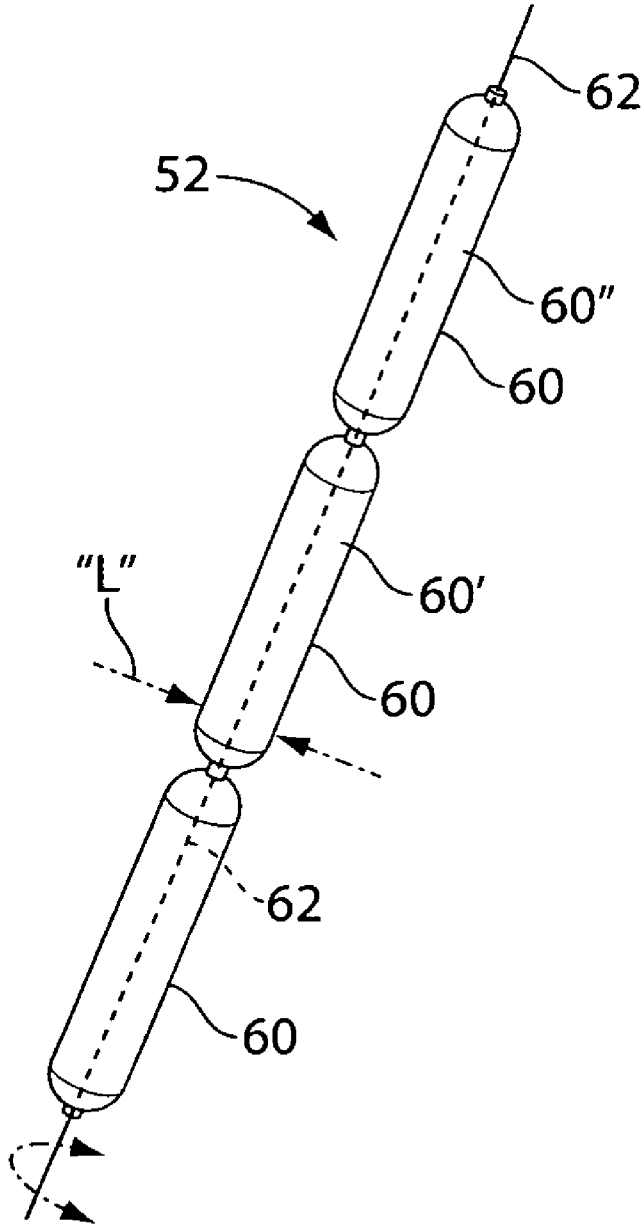
FIG. 4 is a perspective view of a roller link gripping means.

An elongated central support wall 36 is disposed between the first tapered sidewall 24 and the second tapered sidewall 30 in a manner generally perpendicular to the uppermost side 22, as may be seen in FIGS. 1A, 2 and 3. The central support wall 36 has a first or uppermost edge 38 with a connecting support web 40 unitarily extruded therewith, and is connected to an inside portion of the first tapered sidewall 24. A second connecting web 42 is similarly connected between the central support wall 40 and is unitary with the second tapered sidewall 30. The first and second connecting webs 40 and 42 hold the central support wall 36 in generally rigid alignment with the first and second tapered sidewalls 24 and 30 as well as the wall comprising the uppermost side 22.

The central support wall 36 has a distal or lowermost edge 44 which extends beyond the distalmost edge 32 of both the second tapered sidewall 30 and the distalmost edge 26 of the first tapered sidewall 24. A narrow longitudinally extending gap 46 is disposed between the distalmost edge 32 of the second tapered sidewall 30 and the respective side of the central support wall 36, as shown in FIG. 2. A second relatively narrow gap or open band 48 is longitudinally disposed between the central support wall. 36 and the distalmost edge 26 and flange 28 of the first tapered sidewall 24. The volume between the central support wall 36 and the second tapered sidewall 30 defines a "gripping means" enclosure chamber 50, as represented in FIGS. 1A, 2 and 3.

The gripping means enclosure chamber 50 is elongated and is arranged to receive a gripping means 52 disposed longitudinally therewithin. The volume between the central support wall 36 and the first tapered sidewall 24 and its respective connecting web 40 defines an elongated "lift-tool" receiving chamber 54, as shown in FIGS. 1A and 2. The elongated lift-tool receiving chamber 54 is arranged to receive a poster support arrangement lift tool 56, as shown in FIGS. 3, 5, 6, 7 and 8, to permit the raising and lowering of the poster "P" and the poster support arrangement 10 relative to an elevated ceiling rail "R" in a store, as represented by the arrow "A" in FIG. 3.

The gripping means 52 in a first preferred embodiment thereof comprises a plurality of soft resilient "sausage-like" links 60 of resilient material connected therethrough by a central flexible connector line 62. Each of the links 60 may be defined as roller links made of plastic or rubber or the like which are independently movable with respect to its adjacent link in either a twisting or rotation about the common flexible connector line 62 extending therethrough.

The assembly of the poster support arrangement 10 comprises the insertion of a plurality of longitudinally connected resilient roller links 60 arranged within the gripping means enclosure chamber 50 and loosely disposed therewithin, as represented in FIGS. 1A and 3. The end caps 20 may be put on each end 16 and 18 of the longitudinal extrusion 14 to prevent the roller link members 60 from falling out during lifting of the poster support arrangement 10 onto a ceiling rail "R". The end caps 20 may have a slot 23 extending from an apex 25 thereof toward the upper side of the extrusion, as shown in FIG. 1. The slots 23 permit a poster to be easily unloaded from a poster support arrangement 10.

A poster "P" may be inserted within the gripping means enclosure chamber 50 parallel to and along side the central support wall 36, as shown in FIG. 3. Insertion of a flexible poster is accommodated by the roller links 60 neatly rotating about their flexible connector line 62 and permitting the insertion of the poster "P" thereadjacent. Gravity pulls the individual roller links 60 towards the lowermost apex of the poster support arrangement extrusion 14, as shown in FIG. 3, and sufficiently secures it in a pinching manner to prevent the poster "P" from falling out when it is in its overhead location on a ceiling rail "R".

Figure 5:
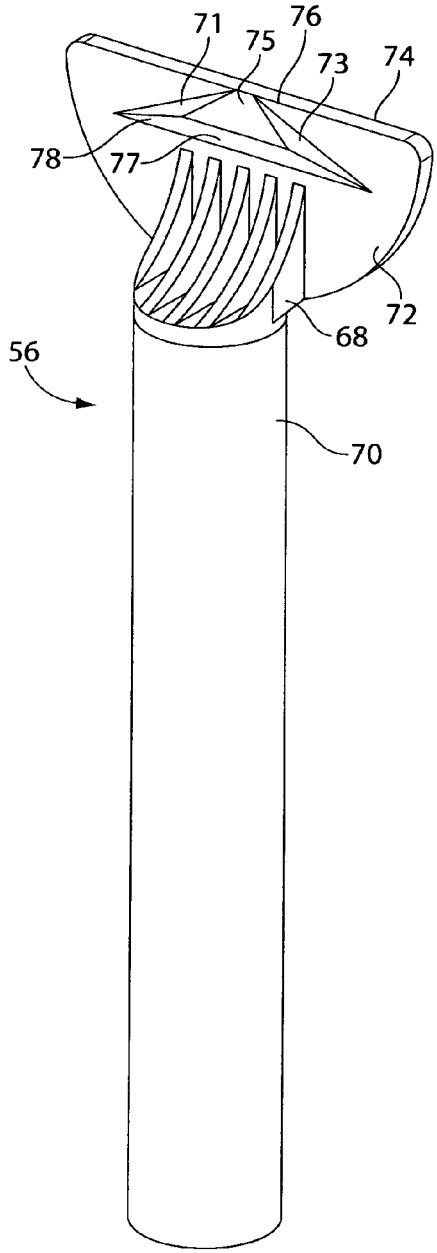
FIG. 5 is a perspective view of the front side of the blade of a poster support arrangement lift tool.
Figure 5A:
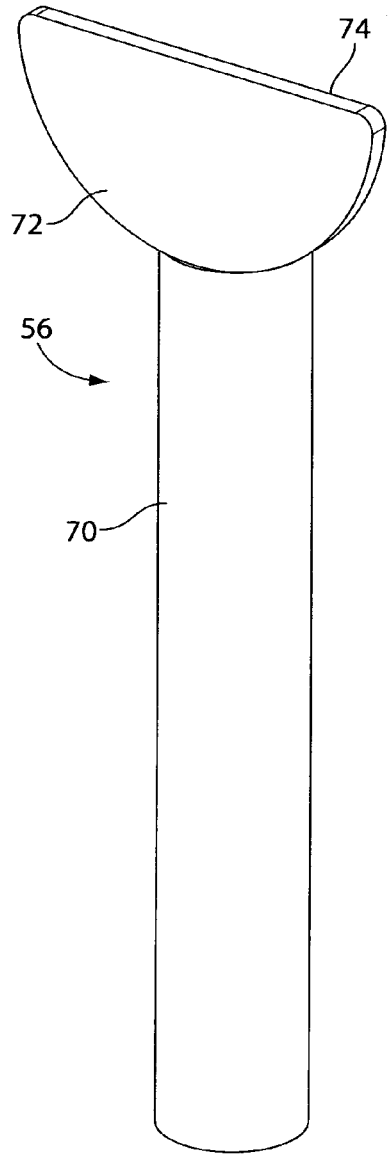
FIG. 5A is a perspective view of the back side of the blade of a poster support arrangement lift tool shown in FIG. 5.
Figure 6:
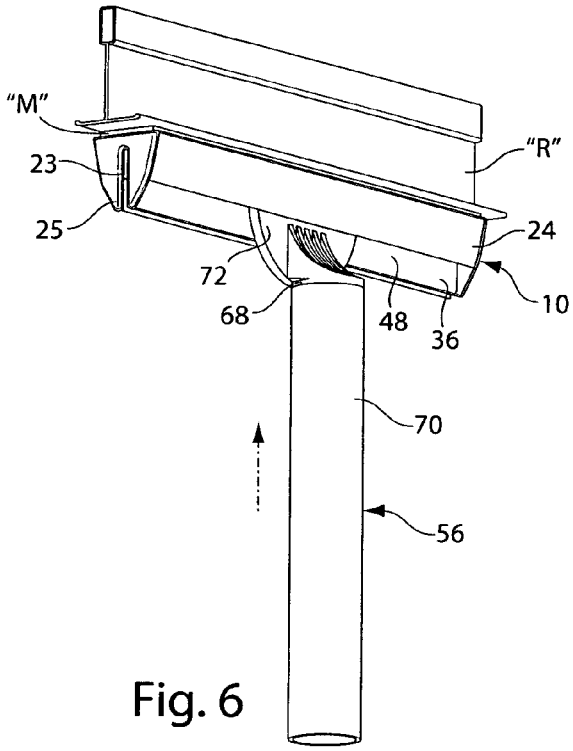
FIG. 6 is a perspective view of a poster support arrangement being attached to a ceiling rail by a poster support arrangement lift tool.

The poster support arrangement lift tool 56 may be utilized to lift the poster support arrangement onto the ceiling rail and secured thereto by a magnetic means "M" therebetween or the like, as represented in FIGS. 3, 6, 7 and 8. The poster support arrangement lift tool 56 comprises a plug 68 fitted on the distalmost end of an elongated pole 70, as shown in FIGS. 5 and 5A. The pole 70 may be telescopable or long enough to reach a ceiling rail "R" supporting ceiling tiles in a store's ceiling. The plug 68 is generally cylindrically shaped and is arranged on the end of the pole 70. A planar blade 72 is arranged on the distal end of the plug 68. The blade 72 may have a linear or straight edge 74 having a scive 76 thereon, and side portions 72 and 73. It is intended that the blade preferably have a width of for example, about 2-3 inches. The planar blade 72 is inserted into the gap 48 between the central support wall 36 and the first tapered wall 24 in the elongated tool receiving chamber 54 therebetween, as shown in FIGS. 3 and 6.

Figure 7:
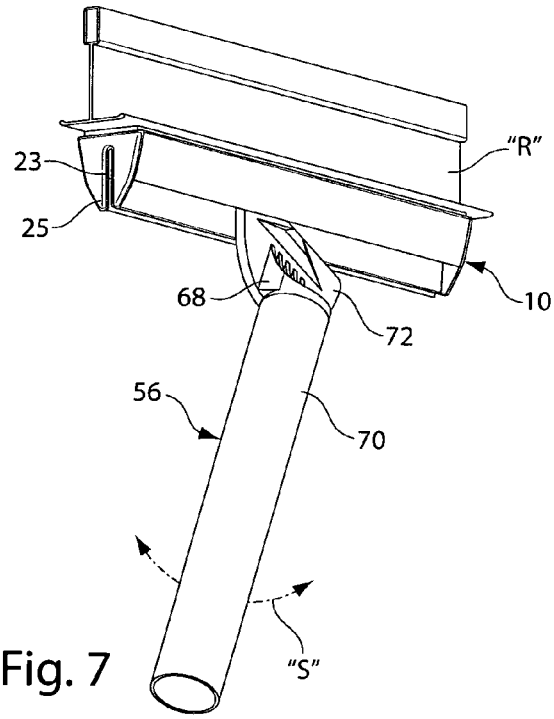
FIG. 7 is a perspective view of a poster support arrangement lift tool releasing itself from a poster support arrangement attached to a ceiling rail.

A tapered lock member 78 may be arranged as wedge on a first or front side of the blade 72 of the tool 56, as shown in FIGS. 3 and 5, so as to provide a slight wedged securement means between the blade 72 and the poster support arrangement 10 during movement thereof, onto a ceiling rail "R", as represented in FIG. 6. The tapered lock member 78 mates within the flange 28 at the lowermost side of the first tapered sidewall 24. A simple side to side pivoting of the blade 72 with respect to the poster support arrangement 10, as represented by the arrows "S" will to permit the separation of blade 72 of the lift tool 56 from the elongated tool receiving chamber 54, as is represented in FIG. 7.

Figure 8:
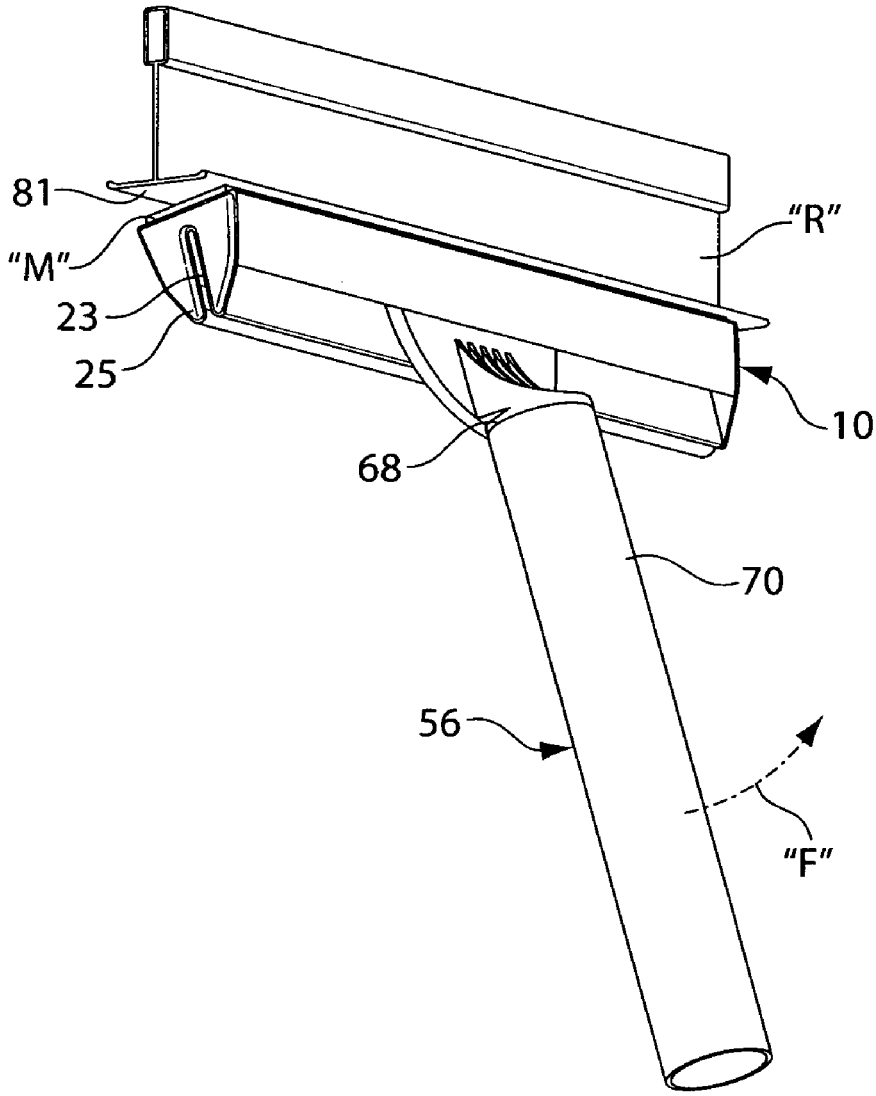
FIG. 8 is a perspective view of a poster support arrangement lift tool removing a poster support arrangement from a ceiling rail.

A tilting of the pole 56 towards the front, away from the plane of the paper, as represented by the arrow "F" in FIG. 8 will separate the magnet strip "M" from the lower surface 81 of the rail "R", to permit the entire poster support assembly to be withdrawn therefrom.

Thus what has been shown is a unique arrangement for supporting a poster on a ceiling rail in a most simple and easily usable manner.

We claim:

1. An elongated poster support arrangement comprising:

an elongated extrusion having an uppermost wall, a first tapered sidewall and a second tapered sidewall, said first and second sidewalls angularly extending from said uppermost wall;

a central support wall arranged between said first and said second tapered sidewalls to define a first longitudinal chamber between said first tapered sidewall and said central support wall and also to define a second longitudinal chamber between said second tapered sidewall and said central support wall; and an arrangement of gripping members loosely disposed within said second longitudinal chamber, said second chamber arranged to receive a poster therein for pinched securement between said gripping members and said central support wall, wherein said first longitudinal chamber has a slot which is arranged to receive a lift tool to permit said poster support to be lifted to a ceiling rail;

wherein said central support wall has a distalmost edge, said first tapered wall has a distalmost edge, and said second tapered wall has a distalmost edge;

wherein said distalmost edge of said central support wall extends beyond said distalmost edges of said first and said second tapered walls;

wherein said central support wall has a proximal edge which is attached to said tapered side walls by a pair of connecting webs, and wherein said first tapered side wall has a flange on its distalmost edge, to facilitate engagement of said lift tool therewith.

2. The elongated poster support arrangement as recited in claim 1, wherein said gripping members comprise a plurality of generally cylindrically shaped links connected longitudinally together by a flexible connecting line.

3. The elongated poster support arrangement as recited in claim 2, wherein said gripping members are formed from a resilient material to enhance their gripping and pinching capabilities.

4. The elongated poster support arrangement as recited in claim 1, wherein said first chamber has an elongated opening to receive said lift tool which comprises a planar blade.

5. The elongated poster support arrangement as recited in claim 4, wherein said planar blade has a locking member thereon to engage said flange on said first tapered side wall of said elongated extrusion.

6. The elongated poster support arrangement as recited in claim 1, wherein said uppermost wall has a magnet member thereon to facilitate attachment of said extrusion to an overhead ceiling rail.

* * * * *